US012134809B2

(12) United States Patent
Lee et al.

(10) Patent No.: US 12,134,809 B2
(45) Date of Patent: Nov. 5, 2024

(54) HIGH STRENGTH STEEL SHEET HAVING EXCELLENT HIGH-TEMPERATURE ELONGATION CHARACTERISTIC, WARM-PRESSED MEMBER, AND MANUFACTURING METHODS FOR THE SAME

(71) Applicant: POSCO Co., Ltd, Pohang-si (KR)

(72) Inventors: Je-Woong Lee, Gwangyang-si (KR); Sang-Ho Han, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 18/144,394

(22) Filed: May 8, 2023

(65) Prior Publication Data

US 2023/0287545 A1 Sep. 14, 2023

Related U.S. Application Data

(62) Division of application No. 16/470,401, filed as application No. PCT/KR2017/014582 on Dec. 12, 2017, now Pat. No. 11,680,305.

(30) Foreign Application Priority Data

Dec. 20, 2016 (KR) ..... 10-2016-0174960

(51) Int. Cl.
*C22C 38/04* (2006.01)
*C21D 8/02* (2006.01)
(Continued)

(52) U.S. Cl.
CPC ..... *C22C 38/04* (2013.01); *C21D 8/0226* (2013.01); *C21D 8/0236* (2013.01); *C22C 38/02* (2013.01);
(Continued)

(58) Field of Classification Search
CPC ..... C21D 1/32; C21D 2211/003; C21D 2211/005; C21D 2211/009; C21D 6/002;
(Continued)

(56) References Cited

U.S. PATENT DOCUMENTS 7,767,044 B2 * 8/2010 Kamikawa ..... C21D 9/38 148/660
11,680,305 B2 * 6/2023 Lee ..... C21D 8/0226 420/104
(Continued)

FOREIGN PATENT DOCUMENTS

CN 102703803 A 10/2012
CN 103764862 B 4/2014
(Continued)

OTHER PUBLICATIONS

U.S. Notice of Allowance dated Feb. 8, 2023 issued in U.S. Appl. No. 16/470,401.
(Continued)

*Primary Examiner* — Jie Yang
(74) *Attorney, Agent, or Firm* — Morgan, Lewis & Bockius LLP

(57) ABSTRACT

An aspect of the present invention relates to a high strength steel sheet having an excellent high-temperature elongation characteristic, wherein the sheet comprises, by weight %, 0.4-0.9% of C, 0.01-1.5% of Cr, 0.03% or less (exclusive of 0%) of P, 0.01% or less (exclusive of 0%) of S, 0.01% or less (exclusive of 0%) of N, 0.01% or less (exclusive of 0%) of sol. Al, and a balance of Fe and inevitable impurities, and comprises at least one among 2.1% or less (exclusive of 0%) of Mn and 1.6% or less (exclusive of 0%) of Si; the sheet has a microcrystalline structure including pearlite having an area fraction of 80% or more and ferrite having an area fraction
(Continued)

of 20% or less; and the pearlite includes cementite having a major axis length of 200 nm or shorter.

4 Claims, 3 Drawing Sheets

(51) Int. Cl.
*C22C 38/02* (2006.01)
*C22C 38/18* (2006.01)

(52) U.S. Cl.
CPC ..... *C22C 38/18* (2013.01); *C21D 2211/005* (2013.01); *C21D 2211/009* (2013.01); *C22C 2204/00* (2013.01)

(58) Field of Classification Search
CPC ..... C21D 6/005; C21D 6/008; C21D 8/02; C21D 8/0205; C21D 8/0226; C21D 8/0236; C21D 8/0263; C21D 9/46; C22C 2204/00; C22C 38/001; C22C 38/02; C22C 38/04; C22C 38/18; C22C 38/34; C22C 38/38; C23C 2/06; C23C 2/12
See application file for complete search history.

(56) References Cited

U.S. PATENT DOCUMENTS

| | | | |
|---|---|---|---|
| 2008/0210352 | A1 | 9/2008 | Kamikawa et al. |
| 2008/0240969 | A1 | 10/2008 | Kim et al. |
| 2011/0259483 | A1 | 10/2011 | Lee et al. |
| 2012/0118443 | A1 | 5/2012 | Lee et al. |
| 2013/0048161 | A1 | 2/2013 | Matsuda et al. |
| 2015/0107725 | A1 | 4/2015 | Posco |
| 2016/0131222 | A1 | 5/2016 | Tagashira et al. |
| 2019/0316235 | A1* | 10/2019 | Lee ..... C22C 38/38 |

FOREIGN PATENT DOCUMENTS

| | | | |
|---|---|---|---|
| CN | 105018835 | A | 11/2015 |
| CN | 105378119 | A | 3/2016 |
| CN | 108950160 | A | 12/2018 |
| EP | 2617840 | A1 | 7/2013 |
| EP | 2778247 | A1 | 9/2014 |
| EP | 2837705 | A1 | 2/2015 |
| EP | 2617840 | B1 | 8/2021 |
| JP | 11-061272 | A | 3/1999 |
| JP | 2000328172 | A | 11/2000 |
| JP | 2003-286542 | A | 10/2003 |
| JP | 2004-068064 | A | 3/2004 |
| JP | 2004308002 | A | 11/2004 |
| JP | 2007-031762 | A | 2/2007 |
| JP | 11269552 | A | 4/2007 |
| JP | 3964246 | B2 | 8/2007 |
| JP | 2010-024503 | A | 2/2010 |
| JP | 2011099129 | A * | 5/2011 |
| JP | 2011-184758 | A | 9/2011 |
| JP | 5035159 | B2 | 9/2012 |
| JP | 2015-503023 | A | 1/2015 |
| JP | 2016-079478 | A | 5/2016 |
| KR | 10-2007-0023831 | A | 3/2007 |
| KR | 10-2009-0070504 | A | 7/2009 |
| KR | 10-2011-0013889 | A | 2/2011 |
| KR | 10-2011-0014852 | A | 2/2011 |
| KR | 10-2014-0035033 | A | 3/2014 |
| KR | 10-2014-0073473 | A | 6/2014 |
| KR | 10-2016-0072359 | A | 6/2016 |
| WO | 2014/196586 | A1 | 12/2014 |

OTHER PUBLICATIONS

U.S. Non-Final Office Action dated Jun. 10, 2022 issued in U.S. Appl. No. 16/470,401.
U.S. Final Office Action dated Jan. 24, 2022 issued in U.S. Appl. No. 16/470,401.
U.S. Non-Final Office Action dated Jul. 20, 2021 issued in U.S. Appl. No. 16/470,401.
Shastry, "Corrossion of Metallic Coated Steels," ASM International, vol. 13B, 2005, pp. 35-39.
European Search Report—European Application No. 17885129.1 issued on Sep. 13, 2019.
International Search Report—PCT/KR2017/014582 dated Apr. 26, 2018 (with English translation).
Chinese Office Action dated Aug. 21, 2020 issued Chinese Patent Application No. 201780078444.9.
Japanese Office Action dated Sep. 29, 2020 issued in Japanese Patent Application No. 2019-532934.
Sun et al., "900 Questions and Answers for Medium Plate Production," Metallurgical Industry Press, Jul. 31, 2014, pp. 72 and 73.

* cited by examiner

[Fig. 1]
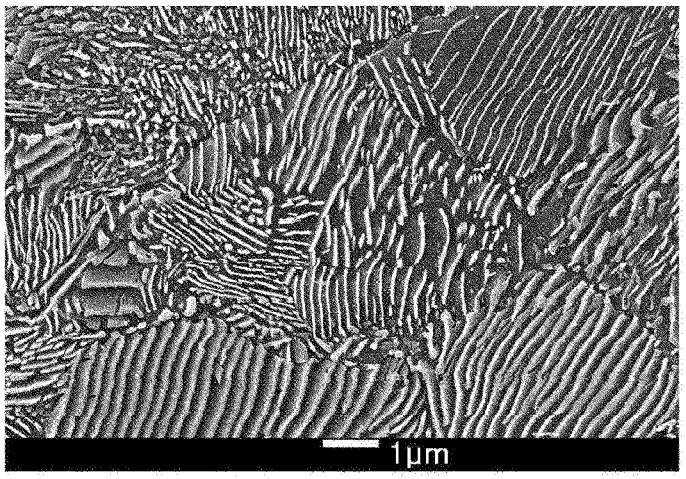
[Fig. 2]
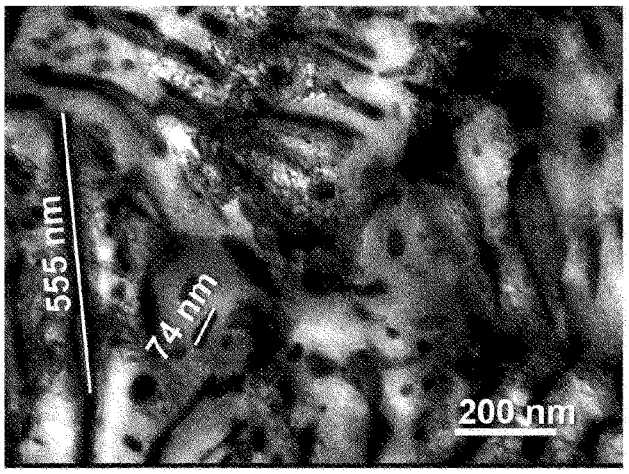

[Fig. 3]
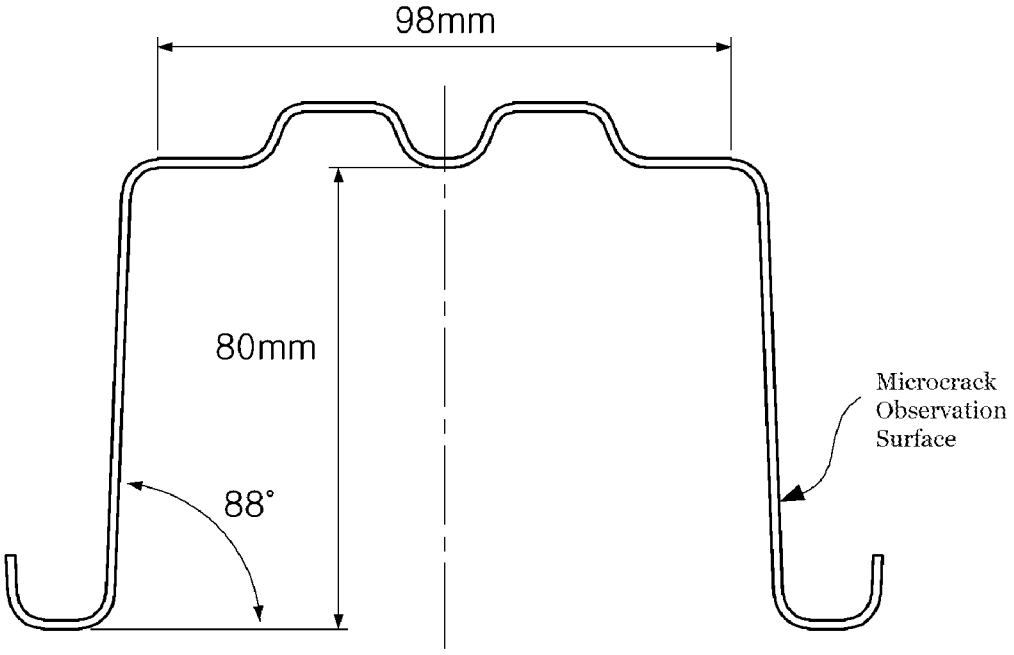

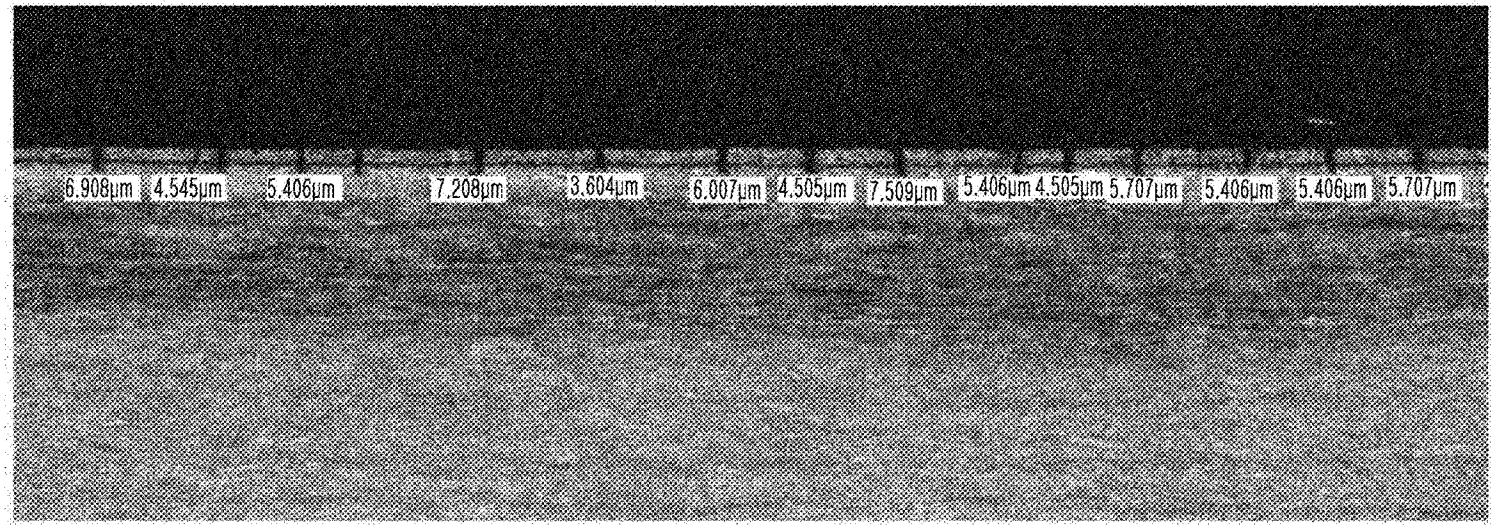
[Fig.4]

HIGH STRENGTH STEEL SHEET HAVING EXCELLENT HIGH-TEMPERATURE ELONGATION CHARACTERISTIC, WARM-PRESSED MEMBER, AND MANUFACTURING METHODS FOR THE SAME

CROSS-REFERENCE TO RELATED APPLICATION(S)

This application is a divisional of U.S. patent application Ser. No. 16/470,401, filed on Jun. 17, 2019, which is the U.S. National Phase under 35 U.S.C. § 371 of International Patent Application No. PCT/KR2017/014582, filed on Dec. 12, 2017, which claims the benefit of priority to Korean Patent Application No. 10-2016-0174960, filed on Dec. 20, 2016, the entire disclosures of which are incorporated herein by reference.

TECHNICAL FIELD

The present disclosure relates to a high strength steel sheet having excellent high-temperature elongation characteristics, a warm-pressed member, and a manufacturing method therefor.

BACKGROUND ART

In recent years, in order to lighten weight, improve fuel efficiency and secure safety of passengers, it has been required to develop steel simultaneously satisfying high strength and high formability requirements. Thus, various studies thereof have been conducted.

A representative steel material satisfying the above-described requirements is austenite-based high manganese steel. In order to secure an austenite single phase structure, it is common to add 0.5 wt % or more of carbon and 15 wt % or more of Mn.

For example, in Patent Document 1, a method in which a large amount of austenite stabilizing elements such as carbon (C) and manganese (Mn), and the like, are added to secure a steel microstructure at room temperature as a austenite single phase and simultaneously secure high strength and excellent formability using twinning generated during deformation, is disclosed.

However, in Patent Document 1, a problem in which not only manufacturing costs of steel sheets are increased due to the addition of a large amount of alloy elements, but also because of high crystal grain energy of an austenite-based microstructure, while cracks in a weld zone due to liquid metal embrittlement may occur during spot welding of a galvanized steel sheet, is disclosed.

In addition, according to Patent Document 2, not only an ultra-high strength member having a tensile strength of 1500 MPa or more may be secured by heating a Zn plating steel sheet to 880° C. or higher by hot press forming and quenching by pressing, but also excellent formability may be secured at a high-temperature.

However, in Patent Document 2, a problem in which not only spot weldability may be reduced due to a Zn oxide formed on a surface of a Zn plating layer at a temperature 880° C. or higher during hot press forming, but also crack propagation resistance is deteriorated, may occur.

Therefore, it is necessary to develop a steel sheet which may solve the problems of the austenite-based high manganese steel and hot press forming.

PRIOR ART DOCUMENT (Patent Document 1) Korean Patent Laid-Open Publication No. 2007-0023831

(Patent Document 2) Korean Patent Laid-Open Publication No. 2014-0035033

DISCLOSURE

Technical Problem

An aspect of the present disclosure is to provide a high strength steel sheet having excellent high-temperature elongation characteristics, a warm-pressed member, and manufacturing methods therefor.

Meanwhile, an aspect of the present disclosure is not limited to the above description. A subject of the present disclosure may be understood from an overall content of the present specification, and it will be understood by those skilled in the art that there will be no difficulty in understanding additional subjects of the present disclosure.

Technical Solution

According to an aspect of the present disclosure, a high strength steel sheet having excellent high-temperature elongation characteristics includes, by weight %, carbon (C): 0.4 to 0.9%, chromium (Cr): 0.01 to 1.5%, phosphorus (P): 0.03% or less (excluding 0%), sulfur (S): 0.01% or less (excluding 0%), nitrogen (N): 0.01% or less (excluding 0%), alkali-soluble aluminum (sol·Al): 0.1% or less (excluding 0%), and a balance of iron (Fe) and inevitable impurities, and includes at least one among manganese (Mn): 2.1% or less (excluding 0%), and silicon (Si): 1.6% or less (excluding 0%), wherein a microstructure includes 80% or more of pearlite and 20% or less of ferrite by area fraction and the ferrite includes cementite having a major axis length of 200 nm or less.

In addition, according to another aspect of the present disclosure, a manufacturing method of a high strength steel sheet having excellent high-temperature elongation characteristics includes steps of: heating a slab including carbon (C): 0.4 to 0.9%, chromium (Cr): 0.01 to 1.5%, phosphorus (P): 0.03% or less (excluding 0%), sulfur (S): 0.01% or less (excluding 0%), nitrogen (N): 0.01% or less (excluding 0%), alkali-soluble aluminum (sol·Al): 0.1% or less (excluding 0%), and a balance of iron (Fe) and inevitable impurities, and including at least one among manganese (Mn): 2.1% or less (excluding 0%), and silicon (Si): 1.6% or less (excluding 0%) to a temperature within a temperature range of 1100° C. to 1300° C.; finishing hot rolling the heated slab at a temperature within a temperature range of Ar3+10° C. to Ar3+90° C. to obtain a hot-rolled steel sheet; coiling the hot-rolled steel sheet at a temperature within a temperature range of 550° C. to 700° C.; and cold rolling the hot-rolled steel sheet at a reduction ratio of 40 to 80% to obtain a cold-rolled steel sheet.

In addition, according to another aspect of the present disclosure, there is provided a warm-pressed member manufactured using a steel sheet of the present disclosure and manufacturing methods thereof.

Further, a solution of the above-mentioned problems does not list all of the features of the present disclosure. The various features and advantages and effects of the present disclosure can be understood in more detail with reference to the following specific embodiments.

Advantageous Effects

According to the present disclosure, it is possible to provide a steel sheet capable of simultaneously securing a tensile strength of 1000 MPa or more at room temperature and elongation of 60% or more in a temperature range of 500° C. to Ac1+30° C.

In addition, it is possible to perform forming in a temperature range of 500° C. to Ac1+30° C., which is lower than a hot press forming temperature in the related art, such that even when a galvanized steel sheet of an alloyed galvanized steel sheet is formed, microcracks may be suppressed.

Accordingly, it may be preferably applied to automobile interior plates or collision members which simultaneously require high strength and high formability.

DESCRIPTION OF DRAWINGS

FIG. 1 is an image of a microstructure of specimen No. 1-1 after hot rolling captured by a scanning electron microscope (SEM).

FIG. 2 is an image of a microstructure of specimen No. 2-1 after cold rolling captured by a transmission electron microscope (TEM).

FIG. 3 is a schematic view illustrating a forming member.

FIG. 4 is an image of a microcrack length of specimen No. 2-1 after warm press forming.

BEST MODE FOR INVENTION

Hereinafter, exemplary embodiments of the present disclosure will be described in detail with reference to the accompanying drawings. The disclosure may, however, be exemplified in many different forms and should not be construed as being limited to the specific embodiments set forth herein, and those skilled in the art and understanding the present disclosure could easily accomplish retrogressive inventions or other embodiments included in the scope of the present disclosure.

The present inventors have conducted intensive research to solve a problem of an increase in manufacturing costs of an austenite-based high manganese steel, a problem of crack occurrence due to liquid metal embrittlement during spot welding, and a problem that propagation resistance and spot weldability are deteriorated due to a high forming temperature in the related art.

As a result, pearlite having segmented cementite was secured by appropriately controlling the alloy composition and manufacturing methods, such that it can be confirmed that a steel plate having excellent strength and excellent elongation at a high temperature within a range of 500° C. to Ac1+30° C., and capable of being formed in a temperature range of 500° C. to Ac1+30° C., which is lower than the hot pressing forming temperature in the related art, thereby completing the present disclosure.

High Strength Steel Sheet Having Excellent High-Temperature Elongation Characteristics Hereinafter, a steel sheet having excellent high-temperature elongation characteristics according to an aspect of the present disclosure will be described in detail.

A steel sheet having excellent high-temperature elongation characteristics according to an aspect of the present disclosure includes, by wt %, carbon (C): 0.4 to 0.9%, chromium (Cr): 0.01 to 1.5%, phosphorus (P): 0.03% or less (excluding 0%), sulfur (S): 0.01% or less (excluding 0%), nitrogen (N): 0.01% or less (excluding 0%), alkali-soluble aluminum (sol·Al): 0.1% or less (excluding 0%), and a balance of iron (Fe) and inevitable impurities, and includes at least one among manganese (Mn): 2.1% or less (excluding 0%) and silicon (Si): 1.6% or less (excluding 0%), wherein a microstructure includes 80% or more of pearlite and 20% or less of ferrite by area fraction, and the ferrite includes cementite having a major axis length of 200 nm or less.

First, an alloy composition of the present disclosure will be described in detail. Hereinafter, a unit of a content of each element may be given in wt % unless otherwise specified.

C: 0.4 to 0.9%

Carbon (C) is a key element in manufacturing a steel sheet having a pearlite microstructure composed of ferrite and cementite after hot rolling in the present disclosure. Generally, the higher content of C, the higher the fraction of the pearlite structure that may be secured, and C is an essential element added to secure the strength of steel.

If the content of carbon (C) is less than 0.4%, it is difficult to sufficiently secure sufficient pearlite. On the other hand, if the content of C exceeds 0.9%, carbides in pearlite may be excessively formed to lower phase-to-phase coherency with precipitates, such that hot rolling properties and room temperature ductility may be lowered, and the granular strength may be drastically increased to decrease the ductility.

Therefore, the content of C is preferably 0.4 to 0.9%, and more preferably, is 0.5 to 0.65%.

Cr: 0.01 to 1.5%

Chromium (Cr) serves to lower the content of carbon required for vacancy composition, similar to Mn. In addition, Cr has a characteristic of promoting formation of cementite and reducing a spacing of lamellas of pearlite, thereby promoting cementite spheroidization. In addition, it also has a property of further improving corrosion resistance of the steel sheet even by adding a small amount of Cr.

If the content of Cr exceeds 1.5%, mechanical properties may be adversely affected, and a surface scale pickling property may be deteriorated during pickling.

If the content of Cr is less than 0.01%, the content of C for the formation of the vacancy pearlite in a hot-rolled state is increased, and not only the spot weldability is greatly deteriorated but also the corrosion resistance basically required in the steel sheet is not affected at all. Thus, the content of Cr is preferably 0.01% or more, more preferably 0.05% or more.

sol·Al: 0.1% or Less (Excluding 0%)

Alkali-soluble aluminum (sol·Al) is an element added for grain size reduction and deoxidation of steel. If the content thereof exceeds 0.1%, there is a problem that not only a possibility of surface defects of the hot-dip galvanized steel sheet may be increased due to excessive formation of inclusions during a steelmaking operation, but also manufacturing costs may be increased.

A lower limit thereof is not particularly limited, but 0% is excluded in consideration of a level which is unavoidably added during a manufacturing process.

P: 0.03% or Less (Excluding 0%)

Phosphorus (P) in steel is an element favorable in strength, but when added excessively, a possibility of an occurrence of brittle fractures is greatly increased, and the possibility of a problem such as slab fractures, or the like during hot rolling may be increased, and phosphorus (P) may act as an element hindering a plating surface characteristic.

Therefore, in the present disclosure, P is an impurity, it is important to control an upper limit thereof, and it is preferable that the content of P is limited to 0.03% or less. However, 0% is excluded in consideration of a level which is inevitably added during the manufacturing process.

S: 0.01% or Less (Excluding 0%)

Sulfur (S) is an element which is inevitably added as an impurity element in the steel, and S in the steel has a problem of increasing the possibility of occurring a red-hot brittleness. It is preferably to control the content thereof to 0.01% or less. However, 0% is excluded in consideration of a level which is inevitably added during the manufacturing process.

N: 0.01% or Less (Excluding 0%)

Nitrogen (N) is an element which is inevitably added as an impurity element in the steel, and it is preferable to control operating conditions to 0.01% or less, which is a possible range. However, 0% is excluded in consideration of a level which is inevitably added during the manufacturing process.

In addition to the above-described components, at least one among Mn: 2.1% or less (excluding 0%) and Si: 1.6% or less (excluding 0%) is included.

Mn: 2.1% or Less (Excluding 0%)

Mn, similar to Cr, serves to lower the content of carbon required for the vacancy composition. In addition, Mn is an element for suppressing the generation of pro-eutectoid ferrite.

If the content of Mn exceeds 2.1%, there is a problem that a low-temperature structure may be caused during cooling.

Si: 1.6% or Less (Excluding 0%)

Silicon (Si) serves to stabilize a layered structure in the pearlite structure and suppress the strength reduction, in addition to a solid solution strengthening effect.

If the content of Si exceeds 1.6%, elongation may be lowered, and the surface of the steel and the plating qualities may be lowered.

A balance of the present disclosure is iron (Fe) However, in the ordinary manufacturing process, impurities which are not intended from a raw material or surrounding environments may be inevitably incorporated, such that it may not be excluded. These impurities are not specifically mentioned in this specification, as they are known to any person skilled in the art of the ordinary manufacturing process.

In this case, not only the content of each element as described above is satisfied, but also the content of C, Cr, Mn, and Si may satisfy the following Relational Expression 1. Relational Expression 1: $0.7 \leq C+Cr/2+Mn/3+Si/4 \leq 3.0$ (in the above Relational Expression 1, each element symbol represents a content of each element in weight %, and is calculated as 0 if not included).

The above following Relational Expression 1 is designed in consideration of influences of each element for manufacturing steel having vacancy composition and the corresponding composition system required in the present disclosure.

When the Relational Expression 1 is less than 0.7, it is difficult to secure pearlite of 80% or more by area after hot rolling. On the other hand, when the value exceeds 3.0, elongation may be lowered due to the addition of a large amount of alloy elements and crack propagation resistance during hot press forming may be deteriorated.

The microstructure of the steel sheet according to the present disclosure includes 80% or more of pearlite and 20% or less of ferrite by area fraction. The pearlite includes cementite having a major axis length of 200 nm or less.

When the pearlite is less than 80%, it is difficult to secure high strength, and elongation may be reduced in high-temperature forming.

The higher the pearlite fraction is, the more advantageous the high strength and high-temperature elongation are secured, so an upper limit thereof is not particularly limited, and it is more preferable to be a pearlite single phase.

Since pearlite includes cementite having a major axis length of 200 nm or less, the segmented cementite may be easily spheroidized in a warm press forming and an annealing process, and thus, the high-temperature elongation and final ductility may be secured to be excellent.

In this case, the cementite of pearlite may have an N value of 60% or more by the following Relational Expression 2.

$$N\ (\%)=Nx/(Nx+Ny)*100 \qquad \text{Relational Expression 2}$$

(in the above Relational Expression 2, Nx is the number of cementite whose length of major axis is 200 nm or less and Ny is the number of cementite whose major axis length exceeds 200 nm).

In the Relational Expression 2, the more, Nx, that is, the number of cementites whose major axis length is segmented to be 200 nm or less, the easier the segmented cementites are spheroidized in a warm press forming or an annealing process, and thus high-temperature elongation and final ductility may be excellently secured.

Therefore, the N value is preferably 60% or more, and more preferably, may be 75% or more.

Meanwhile, the steel sheet of the present disclosure may have a tensile strength of 1000 MPa or more and may have elongation of 60% or more at a high-temperature (500° C. to Ac1+30° C.).

By securing such properties, it is possible to manufacture a high strength warm-pressed member in which fractures did not occur during forming even when forming is performed at a temperature in a range of 500° C. to Ac1+30° C., which is lower than the hot press forming temperature in the related art.

In this case, the Ac1 temperature may be defined by the following Relational Expression 3.

$$Ac1(°\ C.)=723-10.7*Mn-16.9*Ni+29.1*Si+16.9*Cr+290*As+6.38*W \qquad \text{Relational Expression 3}$$

(in the above Relational Expression 3, the symbol of each element represents the content of each element in weight %, and is calculated as 0 if it is not included).

In addition, the steel sheet of the present disclosure may further have one of an aluminum plated layer, a galvanized layer, and a alloyed galvanized layer on the surface thereof.

Manufacturing Method of a High Strength Steel Sheet Having Excellent High-Temperature Elongation Characteristics Hereinafter, a manufacturing method of a high strength steel sheet having excellent high-temperature elongation characteristics will be described in detail according to another aspect of the present disclosure.

A manufacturing method of the high strength steel sheet having excellent high-temperature elongation characteristics according to an aspect of the present disclosure includes steps of: heating a slab having the above-described alloy composition to a temperature of 1100° C. to 1300° C.; finish hot rolling the heated slab in a temperature range of Ar3+10° C. to Ar3+90° C. to obtain a hot-rolled steel sheet; winding the hot-rolled steel sheet at a temperature of 550° C. to 700° C.; cold rolling the wound hot-rolled steel sheet at a reduction rate of 40 to 80% to obtain a cold-rolled steel sheet.

Slab Heating Step

A slab satisfying the above-described alloy composition is heated to a temperature of 1100° C. to 1300° C.

When a heating temperature is lower than 1100° C., it is difficult to uniformize a structure and components of the slab, and when a heating temperature exceeds 1300° C., surface oxidation and facility deterioration may occur.

Hot Rolling Step

The heated slab is finish hot rolled in a temperature range of Ar3+10° C. to Ar3+90° C. to obtain a hot-rolled steel sheet.

When the finish hot rolling temperature is lower than Ar3+10° C., there is a possibility of rolling of ferrite and austenite in two phase regions, which may cause difficulty in control of duplex grain structures and plate shapes in the surface layer of steel, and may also cause non-uniformity of the material.

On the other hand, when the finish hot rolling temperature exceeds Ar3+90° C., a crystal grain coarsening phenomenon of a hot rolling material tends to occur.

Therefore, it is preferable to perform the finish hot rolling in an austenite-based single phase region, in a temperature range of Ar3+10° C. to Ar3+90° C. By performing the finish hot rolling in the above-described temperature range, it is possible to increase uniformity in the structure by applying a more uniform deformation in the microstructure composed of single phase austenite grains.

In this case, the Ar3 temperature may be defined by the following Relational Expression 4.

$$Ar3(^\circ C.)=910-95*(C^{0.5})-15.2*Ni+44.7*Si+104*V+31.5*Mo-(15*Mn+11*Cr+20*Cu-700*P-400*A1-400*Ti) \quad \text{Relational Expression 4}$$

(in the above Relational Expression 4, the symbol of each element represents the content of each element in weight %, and is calculated as 0 if it is not included).

Coiling Step

The hot-rolled steel sheet is coiled at a temperature of 550° C. to 700° C.

If a coiling temperature is lower than 550° C., a low-temperature transformation structure, that is, bainite or martensite, is generated to cause an excessive increase in strength of the hot-rolled steel sheet, thereby causing problems such as shape defects, or the like, due to an excessive load during cold rolling. Thus, it is difficult to obtain a pearlite microstructure, which is the purpose of the present disclosure.

On the other hand, if the coiling temperature exceeds 700° C., excessive oxidation of hot-rolling material at a grain boundary tends to occur, which may result in deteriorating pickling property.

In this case, if necessary, it may further include a step of performing batch annealing at a temperature of 200° C. to 700° C. after the winding step in order to reduce a rolling load before cold rolling.

When a batch annealing temperature is lower than 200° C., a hot-rolled structure is not sufficiently softened and does not significantly affect the reduction of the rolling load, and when the batch annealing temperature exceeds 700° C., pearlite decomposition occurs due to high-temperature annealing. Thus, a pearlite spheroidizing property required in the present disclosure may not be sufficiently exhibited.

Meanwhile, since a heat treatment time for batch annealing is not greatly affected, there is no need to be particularly limited in the present disclosure.

Cold Rolling Step

The hot-rolled steel sheet is cold rolled at a reduction rate of 40 to 80% to obtain a cold-rolled steel sheet.

If the reduction rate is less than 40%, it is difficult to secure a desired thickness, and it may be difficult to sufficiently secure cementite having a major axis length of 200 nm or less. In the case of the hot-rolled steel sheet, it is general to have elongated lamellar cementite if a growth time is sufficient during pearlite transformation. However, if sufficient pearlite transformation time is not given according to winding process conditions after hot rolling, partially segmented may appear even in the hot-rolled steel sheet as illustrated in FIG. 1, but it is possible to sufficiently secure the segmented pearlite. Therefore, in the present disclosure, by performing cold rolling at a reduction rate of 40% or more, cementite having a major axis length of 200 nm or less is sufficiently secured. After cold rolling, the lamellar-shaped cementites are elongated or segmented in the rolling direction, and the layered distance between the cementites becomes close.

On the other hand, if the reduction rate exceeds 80%, there is a high possibility which cracks will occur at an edge portion of the cold-rolled steel sheet, and the cold rolling load may be increased.

In this case, the cold rolling may be performed at room temperature.

According to the present disclosure, characteristics required in the present disclosure may be secured even when warm press forming is performed without performing special annealing after cold rolling.

However, in order to secure more stable material properties, a step of performing continuous annealing or batch annealing the cold-rolled steel sheet in a temperature range of Ac1−70° C. to Ac1+70° C. may be further included.

The lamellar cementites formed during the hot rolling by performing continuous annealing or batch annealing in the above-described temperature range may be spheroidized in a spherical shape. There are two main methods of spheroidizing heat treatment of cementite, a Subcritical annealing method which are performed directly under the temperature of Ac1 and an Intercritical annealing method which are performed at a temperature of the Ac1 to Ac3 temperatures. During subcritical annealing, spheroidization begins with a concentration gradient due to a difference in radii of curvature in a cementite defect portion in the lamellar structure. The cementite particles in the pearlite consist of austenite and unhardened cementite structure, and the unhardened cementite is spheroidized. On the other hand, during intercritical annealing, a certain fraction of ferrite begins to transform into austenite, the cementite particles in pearlite remain undissolved, that is, they are composed of austenite and undissolved cementite structure, and spheroidization progresses using the undissolved cementite serving as a nucleus.

When the annealing temperature is lower than Ac1-70° C., spheroidization of the cementite is difficult to be performed as desired. When the annealing temperature exceeds Ac1+70° C., the shape of the cementite may be uneven due to undissolved cementite, and the like. Therefore, it is preferable to perform continuous annealing or batch annealing in a temperature range of Ac1−70° C. to Ac1+70° C.

Meanwhile, a step of plating the cold-rolled steel sheet may be further included. The plating method and plating type are not particularly limited because they do not greatly affect the material properties even under normal operating conditions.

For example, plating may be performed with aluminum, zinc, an aluminum alloy, a zinc alloy, and the like, and plating may be performed using a hot-dip plating method, an electro plating method, or the like.

In this case, a step of alloying-treating the plated cold-rolled steel sheet may be further included. Like the above plating step, it is not particularly limited because it does not greatly affect the material properties even under normal operating conditions.

For example, alloy treatment may be performed in a temperature range of 400° C. to 600° C.

Warm Pressed Member

Hereinafter, a warm pressed member manufacture using a steel sheet of the present disclosure according to another aspect of the present disclosure will be described in detail.

The warm pressed member according to another aspect of the present disclosure is manufactured by warm press forming the above-described high strength steel sheet of the present disclosure, such that the alloy composition and microstructure remain unchanged and are the same. Therefore, high strength having a tensile strength of 1000 MPa or more may be secured. However, since an N value according to the following Relational Expression 2 is higher than that of the steel sheet by warm press forming, the N value is 70% or more.

$$N\ (\%)=Nx/(Nx+Ny)*100 \qquad \text{Relational Expression 2}$$

(in the above Relational Expression 2, Nx is the number of cementite whose length of major axis is 200 nm or less, and Ny is the number of cementite whose length of major axis exceeds 200 nm).

Meanwhile, an aluminum plated layer may further be formed on the surface of the warm-pressed member, and a galvanized layer or an alloyed galvanized layer may be additionally formed.

In addition, even when the galvanized layer or the alloyed galvanized layer is additionally formed, the length of micro cracks in the member may be 10 μm or less.

Since it is manufactured through warm press forming in a range of 500° C. to Ac1+30° C., which is lower than the hot press forming temperature in the related art, the length of micro cracks generated during forming may be reduced.

Manufacturing Method of a Warm Pressed Member

Hereinafter, a manufacturing method of a warm pressed member according to another aspect of the present disclosure will be described in detail.

The manufacturing method of a warm pressed member according to another aspect of the present disclosure includes a step of heating a steel sheet manufactured by a manufacturing method of the high strength steel sheet having the high-temperature elongation properties described above, and then forming the steel sheet into the press in a temperature of 500° C. to Ac1+30°.

When the warm press forming temperature is lower than 500° C., cementites are not sufficiently spheroidized, and thus the high-temperature elongation properties may be insufficient. On the other hand, when the warm press forming temperature exceeds Ac1+30° C., an oxide is formed on the surface of the steel sheet, and a shot blast process may be further required after the warm press forming process. When a steel sheet in which a galvanized layer or an alloyed galvanized layer is formed is formed, there is a high possibility that Zn is liquefied and diffused into a base iron grain boundary, which may ultimately cause micro cracks.

In the case of a hot press formed member known as a hot press forming (HPF) or a press hardening steel product (PHS) in the related art, an austenite single phase region heat treatment at an annealing temperature of Ac3 or higher in a heating furnace is essentially required in order to obtain a final microstructure as martensite, and the final cooling structure is made of martensite under a cooling condition of a critical cooling rate or more. However, the impact resistance characteristic may be deviated accordingly.

In addition, since the molten Zn in the plating layer on the surface of the steel sheet due to the high-temperature annealing of Ac3 or higher is easily diffused into the base iron grain boundary, there is a possibility of ultimate microcracking at the time of hot press forming is very high, and it is difficult to make the length to be 10 μm or less.

AS described above, since the steel sheet according to the present disclosure has excellent elongation at high temperature (500° C. to Ac1+30°), even if it is press formed at a temperature range of 500° C. to Ac1+30° lower than the conventional hot press forming temperature, it is possible to manufacture a warm press formed member without fracture.

In addition, since it is not necessary to heat up to an austenite singe phase region, pearlite which is not martensite may be secured as a main phase even after forming, and the impact resistance characteristic is excellent.

Further, even when a galvanized layer or an alloyed galvanized layer is additionally formed on the surface of the steel sheet before forming, since it is manufactured through warm press forming in a range of 500° C. to Ac1+30° C., which is lower than the hot press forming temperature in the related art, the length of micro cracks may be reduced.

If microcrack generation mechanism caused by Zn of the galvanized layer and the alloyed galvanized layer is described in detail, generally, in a Fe—Zn state diagram, liquid Zn is generated from a peritectic temperature (about 780° C.). When a heat treatment temperature of a furnace in the related art is higher than Ac3, it is higher than the peritectic temperature, such that liquid Zn is formed on the galvanized layer or the alloyed galvanized layer on the surface of the steel sheet, and the austenite grain boundary diffusion of Zn is facilitated, such that microcracks easily occur in a side surface portion (microcrack observation surface in FIG. 2) of forming parts during subsequent hot press forming, and it is difficult to bring the length to 10 μm or less.

On the other hand, a warm press forming temperature range of the present disclosure is 500° C. to Ac1+30° C., which is lower than the Fe—Zn peritectic temperature, such that the grain boundary diffusion of Zn of liquid phase and solid phase of Zn may be significantly reduced, thereby reducing the amount and length of microcracks generated after hot press forming.

In this case, the forming may be performed at a strain rate of 0.001/s or more.

If the strain rate is less than 0.001/s, it may be more advantageous in terms of high-temperature elongation, workability at the site is very low and productivity may be deteriorated, and thus it is preferably to be performed at a strain rate of 0.001/s or more.

MODE FOR INVENTION

Hereinafter, the present disclosure will be described more specifically with reference to detailed exemplary embodiments. The following exemplary embodiments are merely examples for easier understanding of the present disclosure, and the scope of the present disclosure is not limited thereto.

Embodiment 1

A slab having the component composition shown in the following Table 1 were heat treated in a heating furnace at 1180° C. for 1 hour, and then a cold-rolled steel sheet was manufactured under the conditions shown in the following Table 2. In the following Table 2, an annealing temperature means an annealing temperature after cold rolling, and a symbol represented by '-' means that annealing was not performed after cold rolling.

The microstructure, N value, tensile strength, and high temperature elongation of the cold-rolled steel sheet thus prepared were measured and specified in the following Table 2.

The microstructures were observed by using a scanning electron microscope (SEM) after application of a initial etching method. In the following Tables 2 and 3, P means pearlite, F means ferrite, B means bainite, and M means martensite. The number of cementites according to the major axis length in the microstructure in the cold-rolled steel sheet was measured by using a microstructure observation image by a scanning electron microscope (SEM) and a transmission electron microscope (TEM), respectively, as shown in Table 1.

An average value of the total elongation measured three times under the strain rate condition of 0.001/s at the different experimental temperatures set forth in the following Table 2 were described.

In the following Table 1, an unit of the content of each element is % by weight.

TABLE 1

| Division | Steel type | C | Mn | Cr | Si | P | S | N | sol. Al | Relational Expression 1 | Ac1 (° C.) | Ar3 (° C.) |
|---|---|---|---|---|---|---|---|---|---|---|---|---|
| Inventive Steel | 1 | 0.74 | 0.09 | 0.97 | — | 0.006 | 0.005 | 0.004 | 0.028 | 1.26 | 738 | 832 |
| Inventive Steel | 2 | 0.47 | 2.03 | 1.48 | 1.512 | 0.005 | 0.005 | 0.005 | 0.031 | 2.26 | 770 | 882 |
| Inventive Steel | 3 | 0.49 | 1.04 | 1.47 | 1.482 | 0.007 | 0.005 | 0.004 | 0.048 | 1.94 | 780 | 902 |
| Inventive Steel | 4 | 0.63 | 0.12 | 0.49 | 0.015 | 0.003 | 0.004 | 0.004 | 0.033 | 0.92 | 730 | 843 |
| Inventive Steel | 5 | 0.58 | 0.11 | 0.99 | 0.014 | 0.005 | 0.006 | 0.005 | 0.041 | 1.12 | 739 | 846 |
| Comparative Steel | 6 | 0.0018 | 0.069 | — | 0.009 | 0.005 | 0.002 | 0.005 | 0.024 | 0.03 | 723 | 918 |
| Comparative Steel | 7 | 0.3 | 0.97 | 1.42 | 1.529 | 0.008 | 0.006 | 0.005 | 0.021 | 1.72 | 781 | 910 |
| Comparative Steel | 8 | 0.21 | 1.21 | — | 0.265 | 0.007 | 0.004 | 0.004 | 0.038 | 0.68 | 718 | 880 |
| Inventive Steel | 9 | 0.60 | — | 1.15 | 0.018 | 0.005 | 0.006 | 0.005 | 0.032 | 1.18 | 743 | 841 |
| Comparative Steel | 10 | 0.41 | 0.51 | 0.02 | 0.312 | 0.005 | 0.005 | 0.004 | 0.042 | 0.67 | 720 | 881 |
| Comparative Steel | 11 | 0.58 | 7.01 | 0.11 | 0.415 | 0.007 | 0.006 | 0.006 | 0.036 | 3.08 | 662 | 769 |
| Inventive Steel | 12 | 0.41 | 1.98 | 1.20 | 0.322 | 0.006 | 0.005 | 0.006 | 0.035 | 1.73 | 731 | 836 |

TABLE 2

| | | Hot rolling | | Cooling reduction | Annealing | | N | Tensile | High-temperature tensile | | Remarks |
|---|---|---|---|---|---|---|---|---|---|---|---|
| Steel type | Specimen No. | FDT (° C.) | CT (° C.) | rate (%) | temperature (° C.) | Microstructure (area %) | value (%) | strength (MPa) | Temperature (° C.) | Elonation (%) | (cold-rolled steel sheet) |
| 1 | 1-1 | 912 | 605 | 64 | — | P: 100 | 90.9 | 1324 | 705 | 134 | Inventive Example |
| | 1-2 | 915 | 600 | 15 | 710 | P: 100 | 41.1 | 1259 | 700 | 54 | Comparative Example |
| 2 | 2-1 | 924 | 611 | 71 | 740 | P: 100 | 87.9 | 1457 | 695 | 143 | Inventive Example |
| | 2-2 | 650 | 615 | 59 | — | F: 46, P: 54 | 4.8 | 1215 | 720 | 55 | Comparative Example |
| | 2-3 | 922 | 630 | 5 | — | P: 100 | 25.9 | 1228 | 705 | 53 | Comparative Example |
| | 2-4 | 923 | 603 | 34 | 725 | P: 100 | 57.4 | 1388 | 680 | 57 | Comparative Example |
| | 2-5 | 915 | 620 | 60 | 730 | P: 100 | 79.4 | 1426 | 700 | 148 | Inventive Example |
| 3 | 3-1 | 928 | 594 | 28 | 750 | P: 100 | 58.5 | 1387 | 710 | 52 | Comparative Example |
| | 3-2 | 919 | 413 | 68 | 700 | F: 17, P: 31, B: 52 | 21.6 | 1095 | 720 | 48 | Comparative Example |
| 4 | 4-1 | 920 | 632 | 57 | 765 | P: 100 | 88.9 | 1267 | 715 | 116 | Inventive Example |
| | 4-2 | 920 | 405 | 55 | 715 | F: 14, P: 37, B: 49 | 24.9 | 1087 | 690 | 55 | Comparative Example |
| | 4-3 | 920 | 632 | 73 | — | P: 100 | 81.2 | 1294 | 710 | 131 | Reference Example |
| 5 | 5-1 | 916 | 620 | 75 | — | P: 100 | 79.8 | 1255 | 700 | 119 | Inventive Example |

TABLE 2-continued

| Steel type | Specimen No. | Hot rolling FDT (° C.) | Hot rolling CT (° C.) | Cooling reduction rate (%) | Annealing temperature (° C.) | Microstructure (area %) | N value (%) | Tensile strength (MPa) | High-temperature tensile Temperature (° C.) | High-temperature tensile Elonation (%) | Remarks (cold-rolled steel sheet) |
|---|---|---|---|---|---|---|---|---|---|---|---|
| | 5-2 | 925 | 635 | 64 | 750 | P: 100 | 75.5 | 1296 | 720 | 116 | Reference Example |
| | 5-3 | 904 | 607 | 66 | 650 | P: 100 | 71.7 | 1262 | 710 | 102 | Inventive Example |
| 6 | 6-1 | 932 | 605 | 74 | 780 | F: 100 | — | 335 | 690 | 55 | Comparative Example |
| | 6-2 | 940 | 613 | 77 | 720 | F: 100 | — | 340 | 700 | 57 | Comparative Example |
| 7 | 7-1 | 921 | 589 | 62 | 790 | F: 28, P: 72 | 51.5 | 1321 | 710 | 54 | Comparative Example |
| 8 | 8-1 | 918 | 594 | 65 | 770 | F: 69, P: 31 | 34.5 | 621 | 705 | 58 | Comparative Example |
| | 8-2 | 913 | 607 | 70 | 695 | F: 67, P: 33 | 24.5 | 624 | 730 | 53 | Comparative Example |
| 9 | 9-1 | 920 | 645 | 69 | — | P: 100 | 78.2 | 1276 | 710 | 121 | Inventive Example |
| 10 | 10-1 | 925 | 630 | 68 | — | F: 28, P: 72 | 47.2 | 921 | 715 | 57 | Comparative Example |
| 11 | 11-1 | 840 | 651 | 68 | 705 | M: 100 | — | 1595 | 695 | 65 | Comparative Example |
| 12 | 12-1 | 855 | 625 | 65 | — | F: 12, P: 88 | 71.4 | 1102 | 700 | 71 | Inventive Example |

In the Inventive Example satisfying both the alloy composition and the manufacturing conditions proposed in the present disclosure, it can be confirmed that the microstructure includes 80% or more of pearlite and 20% or less of ferrite by area fraction, and 60% or more of N value, excellent in tensile strength and high temperature tensile elongation.

On the other hand, when the alloy composition and the manufacturing conditions proposed in the present disclosure were not satisfied, pearlite may not be sufficiently secured or the N value was less than 60%, the tensile strength or the high temperature tensile elongation was deteriorated.

Embodiment 2

The cold-rolled steel sheet prepared in Embodiment 1 (specimen No. is identical) was subjected to electro-galvainizing to have a one-side plating amount of 60 g/m$^2$, charged into a heating furnace, heated, and formed and cooled by a press at a forming temperature shown in the following Table 3 to manufacture a HAT-shaped forming member as shown in FIG. 3.

The tensile strength, microstructure, N value, the length of microcracks in the member, and fractures during forming, of the forming member were shown in the following Table 3. However, when the fractures occurred, the tensile strength and the length of microcracks were not measured, and the N value was measured only in the case of Inventive Example.

The tensile test was conducted at a test speed of 10 mm/minute using standard of JIS5 No. specimen.

The microstructure was observed using a scanning electron microscope (SEM) after the application of nital etching. When the microstructure before and after forming were identical, it was indicated as '='.

In addition, the length of micro cracks in the member was measured by optical image analysis as shown in the following FIG. 4, and the average crack depth of 10 micro cracks was measured as shown in the following FIG. 4, which the depth of micro cracks penetrating through the member from an interface between the member and the plating layer.

TABLE 3

| Steel type | Specimen No. | Forming temperature (° C.) | Microstructure (area %) Before forming | Microstructure (area %) After forming | Tensile strength (MPa) | N value (%) | Micro crack length (μm) | Whether Fracture occurred during forming | Remarks (Forming member) |
|---|---|---|---|---|---|---|---|---|---|
| 1 | 1-1 | 505 | P: 100 | = | 1211 | 92.2 | 5.8 | Fracture did not occur | Inventive Example |
| 2 | 2-1 | 554 | P: 100 | = | 1325 | 89.3 | 8.7 | Fracture did not occur | Inventive Example |
| | 2-2 | 625 | F: 46, P: 54 | = | 915 | — | 13.2 | Fracture did not occur | Comparative Example |
| | 2-3 | 315 | P: 100 | = | — | — | — | Fracture occurred | Comparative Example |
| | 2-4 | 810 | P: 100 | M: 100 | 1825 | — | 21.2 | Fracture did not occur | Comparative Example |

TABLE 3-continued

| Steel type | Specimen No. | Forming temperature (° C.) | Microstructure (area %) Before forming | After forming | Tensile strength (MPa) | N value (%) | Micro crack length (μm) | Whether Fracture occurred during forming | Remarks (Forming member) |
|---|---|---|---|---|---|---|---|---|---|
| | 2-5 | 310 | P: 100 | = | — | — | — | Fracture occurred | Comparative Example |
| 3 | 3-2 | 825 | F: 17, P: 31, B: 52 | F: 27, M: 73 | 1688 | — | 15.8 | Fracture did not occur | Comparative Example |
| 4 | 4-1 | 558 | P: 100 | = | 1185 | 90.1 | 9.6 | Fracture did not occur | Inventive Example |
| | 4-2 | 385 | F: 14, P: 37, B: 49 | = | — | — | — | Fracture occurred | Comparative Example |
| | 4-3 | 345 | P: 100 | = | — | — | — | Fracture occurred | Comparative Example |
| 5 | 5-1 | 501 | P: 100 | = | 1196 | 83.2 | 6.9 | Fracture did not occur | Inventive Example |
| | 5-2 | 578 | P: 100 | = | 1234 | 81.5 | 8.1 | Fracture did not occur | Inventive Example |
| | 5-3 | 810 | P: 100 | F: 23, M: 77 | 1798 | — | 20.4 | Fracture did not occur | Comparative Example |
| 6 | 6-1 | 510 | F: 100 | = | 241 | — | — | Fracture did not occur | Comparative Example |
| | 6-2 | 575 | F: 100 | = | 224 | — | — | Fracture did not occur | Comparative Example |
| 7 | 7-1 | 386 | F: 28, P: 72 | = | — | — | — | Fracture occur | Comparative Example |
| 8 | 8-1 | 820 | F: 69, P: 31 | M: 100 | 1525 | — | 18.7 | Fracture did not occur | Comparative Example |
| | 8-2 | 545 | F: 67, P: 33 | = | 817 | — | 12.6 | Fracture did not occur | Comparative Example |
| 9 | 9-1 | 585 | P: 100 | = | 1175 | 80.5 | 9.4 | Fracture did not occur | Inventive Example |
| 10 | 10-1 | 515 | F: 28, P: 72 | = | 768 | — | — | Fracture did not occur | Comparative Example |
| 11 | 11-1 | 310 | M: 100 | = | — | — | — | Fracture occurred | Comparative Example |
| 12 | 12-1 | 585 | F: 12, P: 88 | = | 1008 | 78.9 | 9.2 | Fracture did not occur | Inventive Example |

When the cold-rolled steel sheet satisfying all the alloy composition and the manufacturing conditions proposed in the present disclosure was formed in a temperature range of 500° C. to Ac1+30° C., it can be confirmed that factures did not occur during forming, and the length of microcracks was observed to be 10 μm or less.

However, even when the cold-rolled steel sheet satisfying all the alloy condition and the manufacturing conditions proposed in the present disclosure was used, fractures of the forming member of Specimen Nos. 2-5 and 4-3 having low forming temperatures occurred.

In addition, even when the cold-rolled steel sheet satisfying all of the alloy composition and the manufacturing conditions was used, it can be confirmed that the forming member of Specimen No. 5-3 having a high forming temperature has microcracks having a length exceeding 10 μm.

When the cold-rolled steel sheet, not satisfying the alloy composition and the manufacturing conditions proposed in the present disclosure was used, fractures occurred during forming or a length of microcracks exceeded 10 μm, regardless of whether or not the forming temperature satisfies the forming temperature proposed in the present disclosure.

While example embodiments have been shown and described above, it will be apparent to those skilled in the art that modifications and variations could be made without departing from the scope of the present inventive concept as defined by the appended claims.

The invention claimed is:

1. A high strength steel sheet having excellent high-temperature elongation characteristics, comprising, by weight %:

carbon (C): 0.4 to 0.9%, chromium (Cr): 0.01 to 1.5%, phosphorus (P): 0.03% or less (excluding 0%), sulfur (S): 0.01% or less (excluding 0%), nitrogen (N): 0.01% or less (excluding 0%), alkali-soluble aluminum (sol·Al): 0.10% or less (excluding 0%), a balance of iron (Fe) and inevitable impurities, and comprising at least one among manganese (Mn): 2.1% or less (excluding 0%), and silicon (Si): 1.6% or less (excluding 0%), wherein a microstructure comprises 80% or more of pearlite and 20% or less of ferrite by area fraction, wherein the pearlite comprises cementite having a major axis length of 200 nm or shorter, and wherein the cementite of the pearlite has an N value of 60% or more according to the following Relational Expression 2, $$N\ (\%)=Nx/(Nx+Ny)*100 \qquad \text{Relational Expression 2}$$

in the above Relational Expression 2, Nx is the number of cementite whose major axis length is 200 nm or less, and Ny is the number of cementite whose major axis length exceeds 200 nm.

2. The high strength steel sheet having the high temperature elongation characteristic of claim 1, wherein the steel sheet satisfies the following Relational Expression 1, $$0.7 \leq C+Cr/2+Mn/3+Si/4 \leq 3.0 \qquad \text{Relational Expression 1}$$

where a symbol of each element represents a content of each element in weight %, and is calculated as 0 if not included.

3. The high strength steel sheet having the high temperature elongation characteristic of claim 1, wherein the steel sheet has a tensile strength of 1000 MPa or more and an elongation of 60% or more in a temperature range of 500° C. to Ac1+30° C.

4. The high strength steel sheet having the high temperature elongation characteristic of claim 1, wherein the steel sheet further has one of an aluminum plated layer, a galvanized layer, and an alloyed galvanized layer on its surface.

* * * * *